US005699904A

United States Patent [19]

Ikemoto

[11] Patent Number: 5,699,904

[45] Date of Patent: Dec. 23, 1997

[54] CASE FOR STORING BAND-SHAPED PERSONAL ORNAMENT

[75] Inventor: Shigeki Ikemoto, Higashiosaka, Japan

[73] Assignee: Ikemoto Brush Industry Co., Ltd., Higashiosaka, Japan

[21] Appl. No.: 628,265

[22] Filed: Apr. 5, 1996

[51] Int. Cl.[6] ..... B65D 85/18

[52] U.S. Cl. ..... 206/296; 206/292; 206/278; 242/395; 242/597.8

[58] Field of Search ..... 206/389, 278, 206/292, 296, 293; 242/395, 597.5, 597.8

[56] References Cited

U.S. PATENT DOCUMENTS

| | | | |
|---|---|---|---|
| 1,476,604 | 12/1923 | Foreman | 242/395 |
| 2,352,427 | 6/1944 | Gantt | 206/7 |
| 3,131,805 | 5/1964 | Gardner | 206/7 |
| 3,647,059 | 3/1972 | Humphreys | 242/597.8 |
| 3,903,719 | 9/1975 | Katz | 242/395 |
| 4,008,351 | 2/1977 | Inoue et al. | 428/411 |
| 5,086,988 | 2/1992 | LaPoint et al. | 242/395 |
| 5,181,670 | 1/1993 | Eaton et al. | 206/296 |
| 5,540,500 | 7/1996 | Tanaka | 383/43 |

*Primary Examiner*—David T. Fidei
*Attorney, Agent, or Firm*—Armstrong, Westerman, Hattori, McLeland & Naughton

[57] ABSTRACT

A case for storing a band-shaped personal ornament provided with a case body which has a cylindrical configuration with an opening portion at one end side and a wall portion at the other end side and has a circumferential wall having a slit window portion parallel with a direction of an axis of the case body. A cap is attached to the opening portion of the case body, and freely rotates toward the circumferential direction and is detachable. A bar for winding a band-shaped personal ornament which approximately coincides with the axis of the case body is attached to an inner face of the cap. A holding portion for holding an end portion of the bar for winding a band-shaped personal ornament is placed at a central portion of an inner face of the wall portion of the case body and the end portion rotates freely. The bar for winding a band-shaped personal ornament bifurcates into a long piece and a short piece between which a part of a band-shaped personal ornament is held.

10 Claims, 9 Drawing Sheets

CASE FOR STORING BAND-SHAPED PERSONAL ORNAMENT

BACKGROUND AND SUMMARY OF THE INVENTION

This invention relates to a case for storing a band-shaped personal ornament.

Conventionally, a band-shaped personal ornament such as a ribbon or a muffler is often folded up or rolled in order to take it, in a bag or other piece of luggage, on a journey or on a business trip.

However, if the band-shaped personal ornament is folded up, it becomes rumpled, and if the band-shaped personal ornament is rolled to form a rolled article, the rolled article may become more loosely rolled and thus, become wrinkled. Moreover, it is bothersome to roll a band-shaped personal ornament which is long.

It is therefore an object of the present invention to provide a case for storing a band-shaped personal ornament wherein the above-mentioned problems are solved and a band-shaped personal ornament is easily stored in a compact space either, without forming wrinkles, or in a manner wherein wrinkles on the ornament are smoothed away when the ornament is stored.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
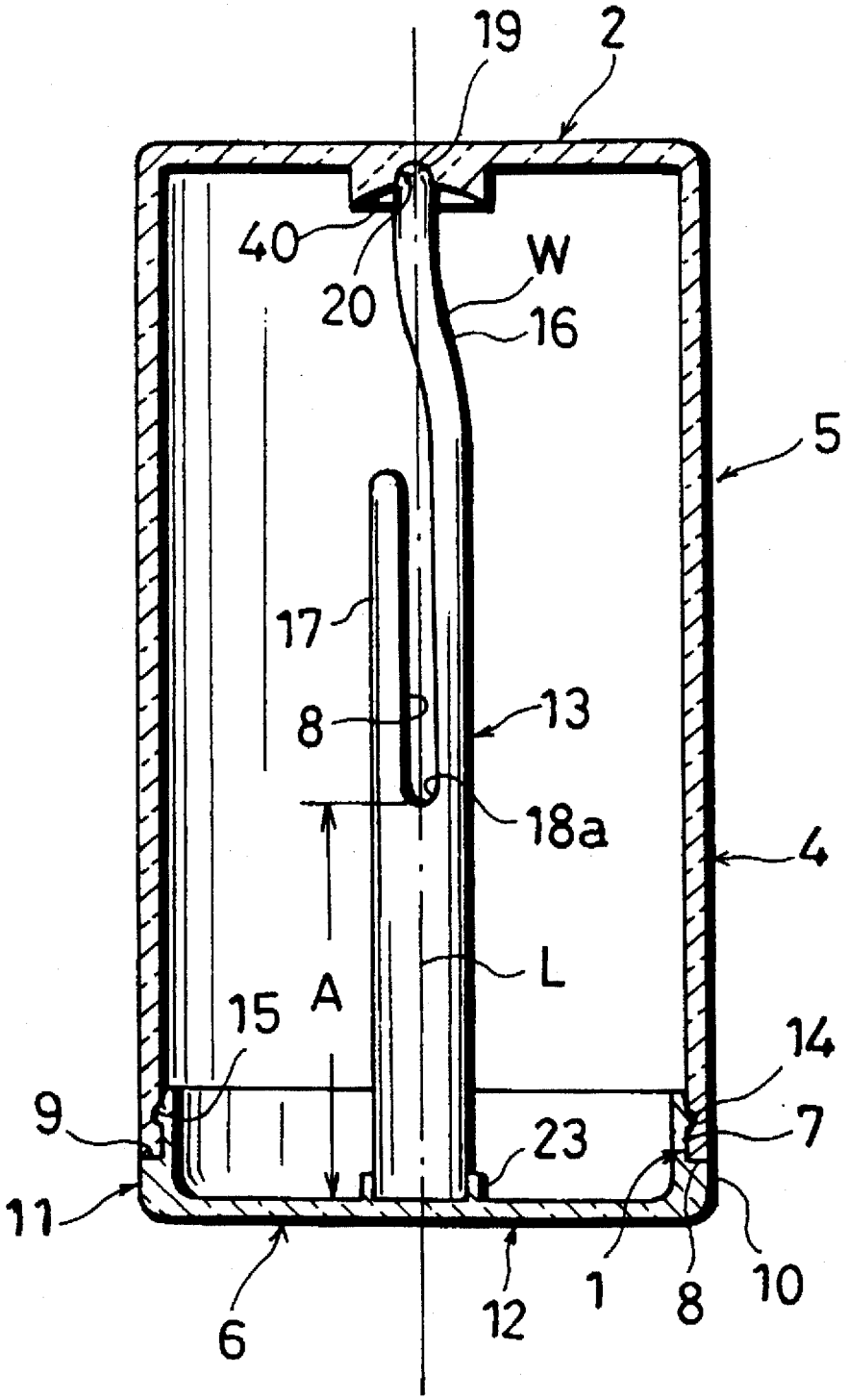
FIG. 1 is a cross-sectional view of an embodiment of a case for storing a band-shaped personal ornament according to the present invention.
Figure 2:
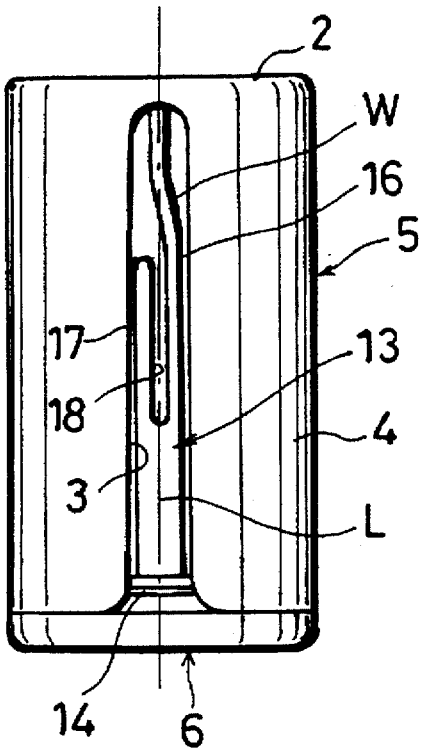
FIG. 2 is an elevational view of the case for storing a band-shaped personal ornament.

FIG. 2 shows a preferred embodiment of a case for storing a band-shaped personal ornament according to the present invention. This case has a cylindrical configuration with an opening portion 1 at one end (see FIG. 1) and a wall portion 2 at the other end. The case is provided with a case body 5 having a circumferential wall 4 with a slit window portion 3 parallel to a direction of an axis L of the case body 5. The case body 5 has a cap 6 which is detachable and freely rotates in a circumferential direction at the opening portion 1 of the case body 5. Each of the case body 5 and the cap 6 are formed from transparent resin as one body.

As shown in FIG. 1, the cap 6 includes a cylindrical circumferential wall portion 11. The cylindrical circumferential wall portion 11 includes a thin-walled cylindrical portion 7 fitted in the opening portion 1 of the case body 5 and slid freely along the circumferential direction. The cylindrical circumferential wall portion 11 also includes a thick-walled cylindrical portion 10 having a stepped face 9 which receives an opening end face 8 of the case body 5. The cap 6 also includes a cap wall portion 12 which is formed integrally with the circumferential wall portion 11 and covers an outer marginal end of the thick-walled cylindrical portion 10 of the circumferential wall portion 11. The cap 6 also includes a bar 13 for holding a band-shaped personal ornament which is attached to a central portion of an inner face of the cap wall portion 12. In other words, the bar 13 projects from an inner face of the cap 6 and coincides approximately with the axis L of the case body 5. In the illustration, the cap 6 and the bar 13 are arranged to be separate members, a ring 23 is arranged at a central portion of the inner face of the cap 6, and a base of the bar 13 is inserted and fixed in a portion of the ring 23. However, it is possible to form the cap 6 and the bar 13 as one united or integral body.

On an outer circumferential face of the thin-walled cylindrical portion 7 of the circumferential wall portion 11 of the cap 6, a small linear stopper protuberance 14 is formed along the circumferential direction. A circumferential groove 15 is formed on an inner circumferential face near the opening portion 1 of the case body 5, and the small linear stopper protuberance 14 is freely fitted in and removed from the circumferential groove 15.

The small linear stopper protuberance 14 is fitted in adjacently to the circumferential groove 15 with the thin-walled cylindrical portion 7 of the circumferential wall portion 11 of the cap 6 fitted in the opening portion 1 of the case body 5. The cap 6 is thus attached to the case body 5. Under this situation, the cap 6 freely rotates on the axis against the case body 5. Because of the thin-walled cylindrical portion 7, the circumferential wall 4 of the case body 5 does not bend inwardly when the case is held by hand. The cap 6 can be removed from the case body 5 by pulling the cap 6 outwardly along the axis L against the case body 5 and enlarging the opening portion 1 of the case body 5 due to elastic deformation.

A first end of the bar 13 is bifurcated into a long piece 16 and a short piece 17. The portion between the long piece 16 and the short piece 17 is a slit 18 for holding a band-shaped personal ornament. In this case, an end portion 19 of the long piece 16, i.e., an end portion of the bar 13, substantially coincides with the axis L through a curved portion W of the bar 13. The inner most recess 18*a* of the slit 18 is arranged at a predetermined distance A from a second end of the bar 13 toward the center of the bar 13. That is to say, the slit 18 is arranged at a substantially central portion in the axial direction of the bar 13.

A holding portion 20 is arranged at a central portion of an inner face of the wall portion 2 of the case body 5 and holds the end portion 19 of the bar 13 of the cap 6 so that the end portion 19 rotates freely. The holding portion 20 is formed as a circular depression, and the end portion 19 of the bar 13 is fitted in the holding portion 20 and freely rotates on the axis L. The holding portion 20 has an open marginal end as the circular depression is provided with an inclined face 40 for guiding the end portion 19 of the long piece 16 of the bar 13 into the holding portion 20.

Figure 3:
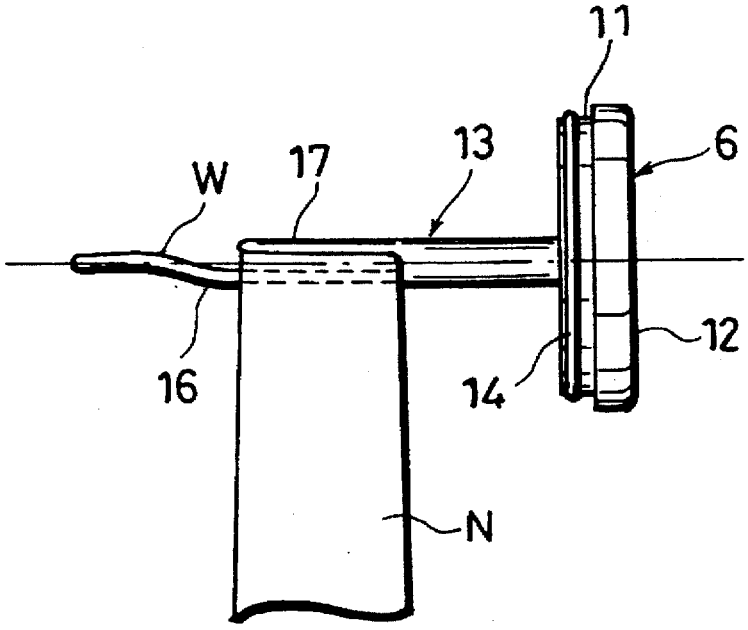
FIG. 3 is an explanatory view of the case in which a band-shaped personal ornament is attached.

The case for storing a band-shaped personal ornament of the present invention is used as described below. First, the cap 6 is removed from the case body 5 and a part of a band-shaped personal ornament N is held in place by the bar 13 of the cap 6 as shown in FIG. 3. To be specific, a portion approximately at the middle of the ornament N is inserted through the slit portion 18 formed between the long piece 16 and the short piece 17 of the bar 13. The band-shaped personal ornament N described herein is, for example, a band-shaped ribbon, a muffler, or a necktie.

Figure 4:
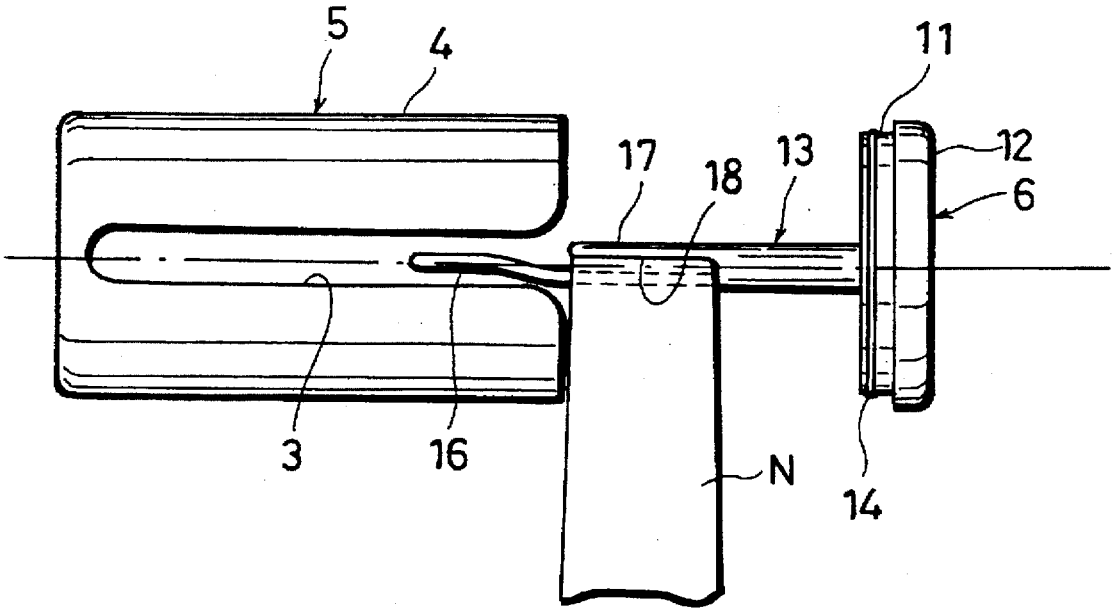
FIG. 4 is an explanatory view of a method of how a band-shaped personal ornament is stored in the case.

After that, as shown in FIG. 4, the bar 13 of the cap 6 is inserted into the case body 5 so that the cap 6 caps the case body 5. The ornament N is passed through the slit window portion 3 of the case body 5, and the cap 6 is rotated against the case body 5 as shown with an arrow C in FIG. 5 and FIG. 6. The ornament N is thereby wound around the bar 13 and stored inside the case body 5. Wrinkles on the ornament N are smoothed away by winding the ornament N around the bar 13. In this case, the slit 18 is arranged at approximately the middle in the axial direction of the bar 13. Therefore, the ornament N is wound at the center of the bar 13, and this prevents the ornament N from interfering with the inner faces of both of the end walls of the case body 5.

Figure 7:
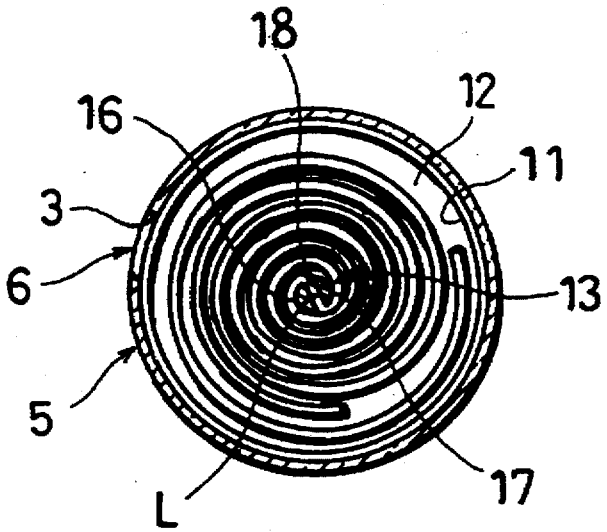
FIG. 7 is a top plan view in section showing a situation in which a band-shaped personal ornament is completely stored in the case.

The ornament N wound around the bar 13 is thereby stored in the case body 5 as shown in FIG. 7. The ornament N is thereby stored compactly without forming wrinkles on the ornament N. This is a convenient way to take the ornament N on a journey or on a business trip.

Figure 8:
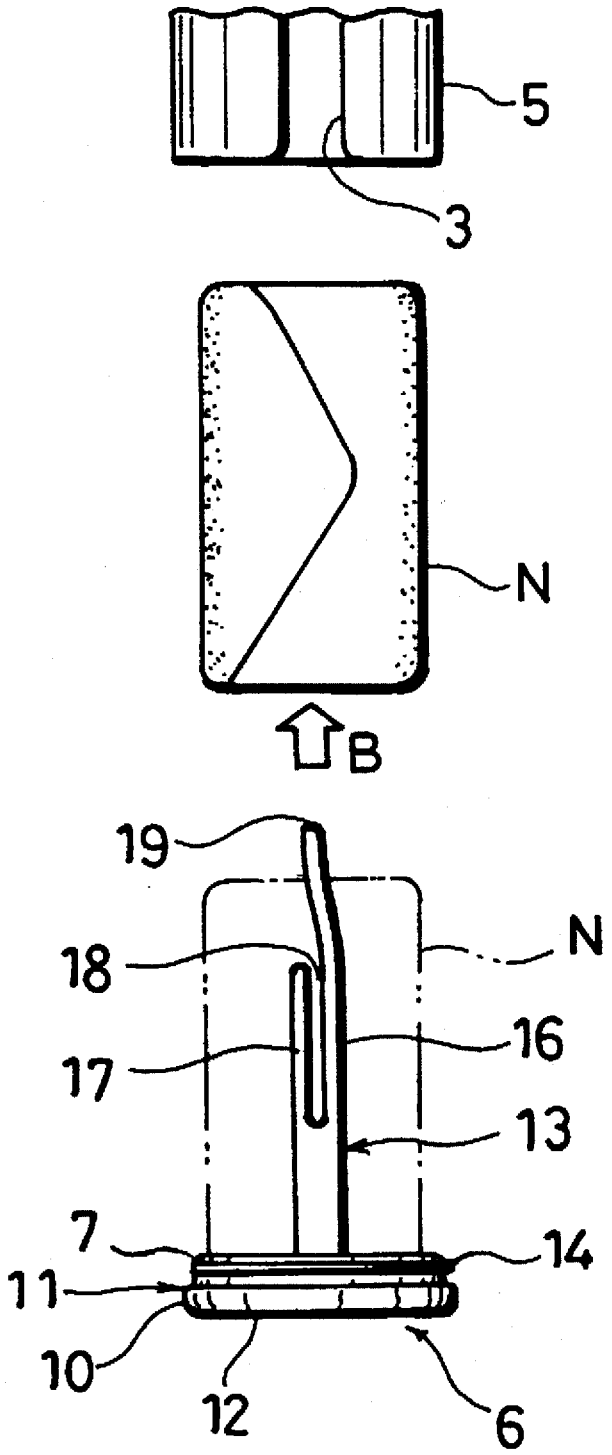
FIG. 8 is a schematic illustration showing a method of how a band-shaped personal ornament is taken out of the case.

The stored ornament N is taken out by removing the cap 6 from the case body 5 and pulling the ornament N toward the end portion 19 against the bar 13 of the cap 6 as shown with arrow B in FIG. 8.

Figure 5:
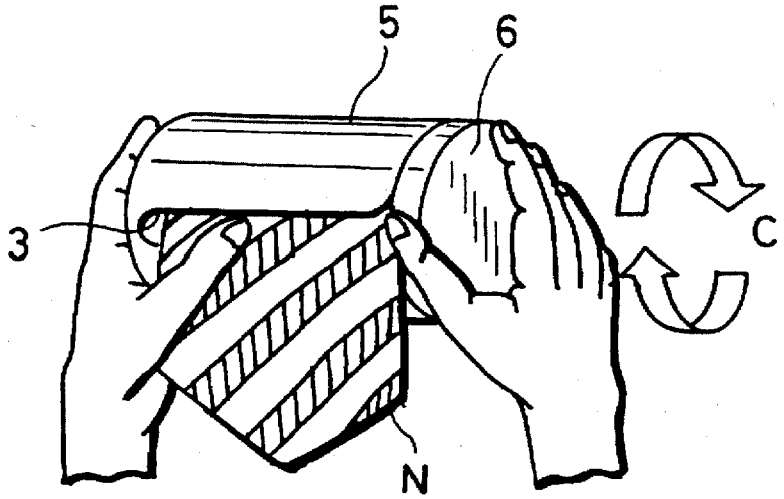
FIG. 5 is an explanatory view of a method of how a band-shaped personal ornament is stored in the case.
Figure 6:
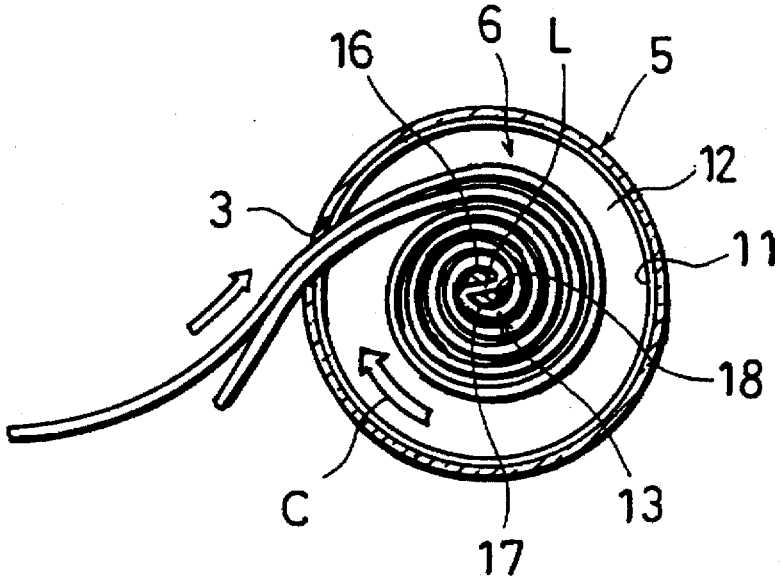
FIG. 6 is a top plan view in section showing a band-shaped personal ornament being stored in the case.

It is possible to pull an end portion of an ornament N from the slit window portion 3 of the case body 5 as shown in FIG. 5 and to display it in the window of a shop. The case body 5 and the cap 6 are transparent. Therefore, a stored portion of the ornament N can be clearly seen from outside of the case. In case of selling the ornament N, the ornament can be swiftly packed up by completely storing the ornament N in the case and wrapping the ornament N up in paper. It is unnecessary to pack it in a box, and moreover, it is possible to display an ornament N completely stored in the case (see FIG. 7) because the case body 5 is transparent.

Figure 9:
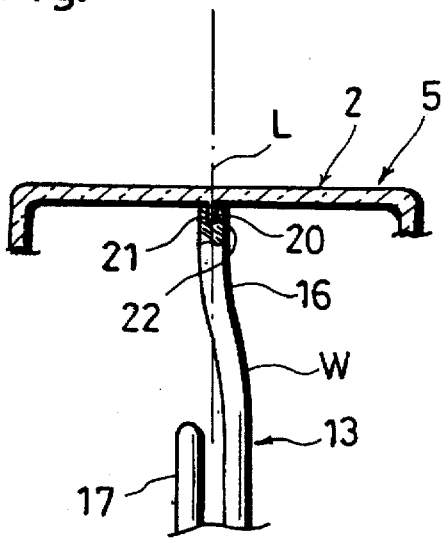
FIG. 9 is a cross-sectional view showing a modification of a holding portion of the case.

FIG. 9 shows a modification of the holding portion 20 wherein a holding portion 20 is formed by a small projection 21 formed on an inner face of a wall portion 2 of a case body 5. A depression 22 is formed at an end portion 19 of a bar 13, and the small projection 21 fits in the depression 22 and the small projection 21 freely rotates on an axis L of the case body 5.

Figure 10:
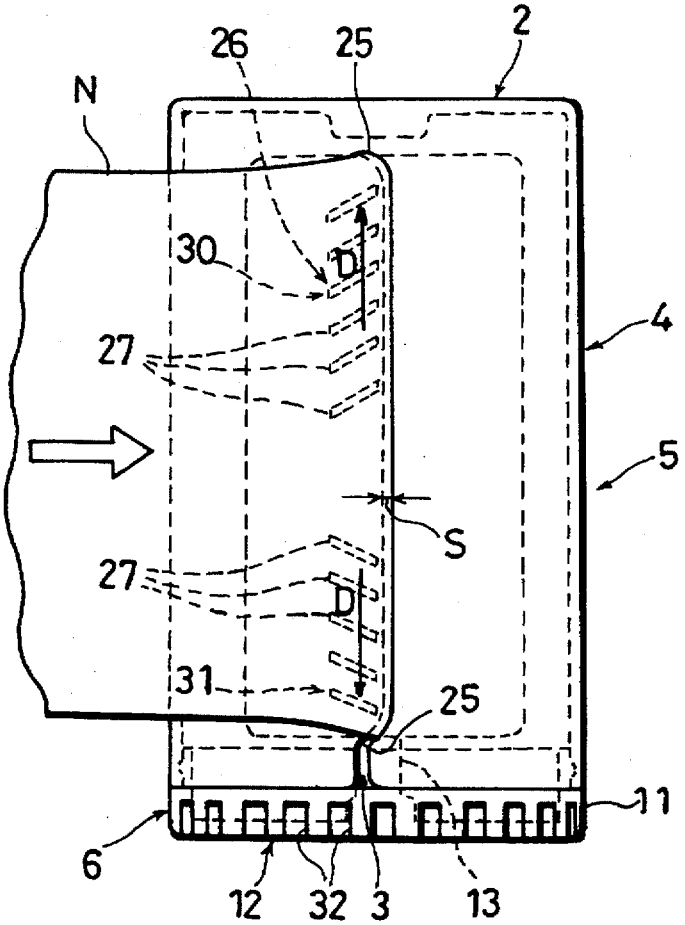
FIG. 10 is an elevational view showing another embodiment of the present invention.
Figure 11:
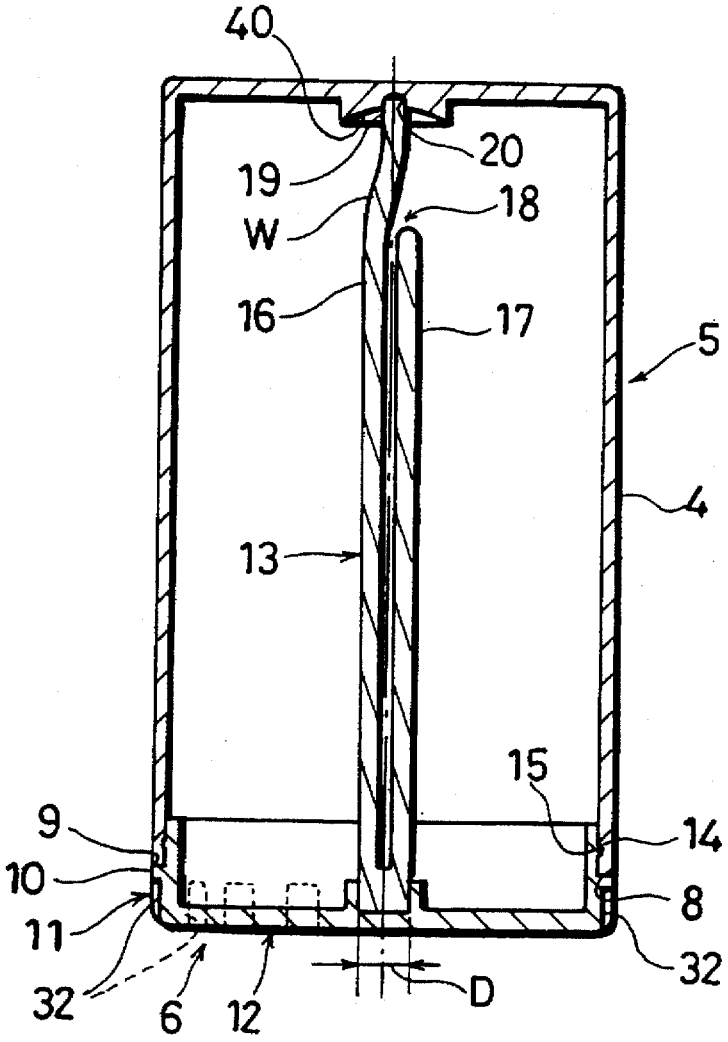
FIG. 11 is a cross-sectional view of the embodiment of FIG. 10.

Next, FIG. 10 and FIG. 11 show another modification wherein both end portions 25 of a slit window portion 3 of a case body 5 are arc-shaped when viewed from the front, and a guide portion, with protrusions and depression 26 for spreading an ornament N to be stored toward the width direction, is arranged near the slit window portion 3.

In concrete terms, the guide portion with protrusions and depressions 26 is provided with a first portion 30 comprising small linear protrusions 27 arranged at the side of the wall portion 2 and a second portion 31 comprising small linear protrusions 27 arranged at the side of the opening portion 1. The small linear protrusions 27 arranged near a marginal end of the slit window portion 3 along the axial direction at regular intervals. When one of the ends of each small linear protrusion 27 which is nearer to the slit window portion 3 is defined as an end portion, the end portions of the small linear protrusions 27 of the first portion 30 are inclined toward the wall portion 2, and the end portions of the small linear protrusions 27 of the second portion 31 are inclined toward the opening portion 1.

Figure 12:
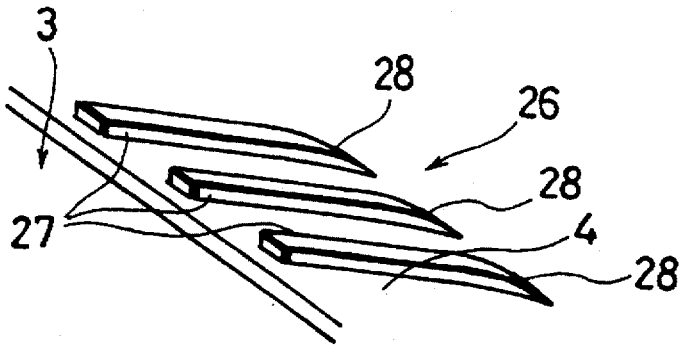
FIG. 12 is a partial perspective view of the embodiment of FIG. 10.

Tapers 28 are respectfully formed at the base end portions of the small linear protrusions 27 as shown in FIG. 12, and prevent an ornament N from being hooked at the base end portions when the ornament N is being wound.

In this case, a clearance width S of the slit window portion 3 of the case body 5 is arranged to be smaller than an outer diametral dimension D of the bar 13. To be concrete, the clearance width S of the slit window portion 3 is arranged to be approximately the same width or slightly larger than a thickness of an ornament N.

In the preferred embodiment shown in FIG. 10 and FIG. 11, depressed grooves 32 for preventing slippage are formed on the outer circumferential face of the cap 6. However, it is possible to omit the depressed grooves 32, and it also is possible to form protrusions for preventing slippage instead of forming the depressed grooves 32.

In a similar manner with the foregoing embodiment, this case may be used by passing an ornament N through the slit window portion 3 of the case body 5, holding a part of the ornament N at the slit 18 between the long piece 16 and the short piece 17 of the bar 13, and rotating the cap 6 as shown with an arrow C (see FIG. 5) against the case body 5.

That is to say, when the ornament N is gradually drawn inside from the slit window portion 3 of the case body 5 and wound around the bar 13, a friction force occurs between the slit window portion 3 and the ornament N because the clearance width S of the slit window portion 3 is small. Therefore, tension in the longitudinal direction is loaded on the ornament N which has passed through the slit window portion 3, and the ornament N is stretched toward the longitudinal direction, while the ornament N is being wound.

When the ornament N is wound as described in the foregoing, as shown in FIG. 10, the ornament N slides on the guide portion with protrusions and depressions 26 (the small linear protrusions 27) and advances toward the slit window portion 3. The ornament N is therefore spread toward the width direction as shown with arrows D by the guide portion with protrusions and depressions 26. Moreover, the ornament N slides on one of the opposed marginal ends of the slit window portion 3 and passes through the slit window portion 3. Both marginal ends in the width direction of the ornament N are thereby guided outwardly in the width direction by both the curved end portions 25 of the slit window portion 3. Therefore, the ornament N is smoothly and accurately spread toward the width direction.

As described above, in the embodiment shown in FIG. 10, this case is suitable for storing an elastic ornament N, and the ornament N can be wound under a situation of being spread toward the width direction, or the ornament N can be wound uniformly and smoothly without forming wrinkles.

Figure 13A:
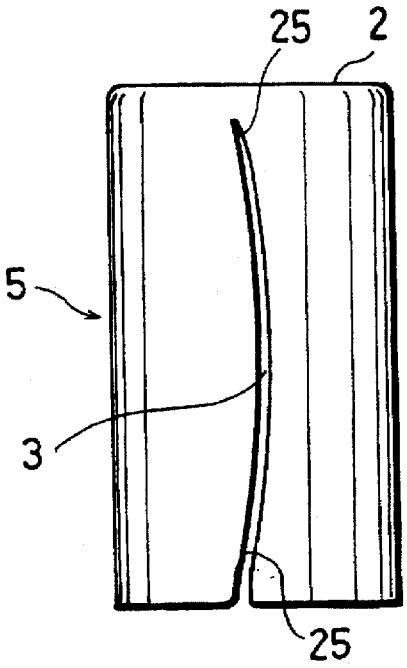
FIG. 13A is a schematic illustration showing a modification.
Figure 13B:
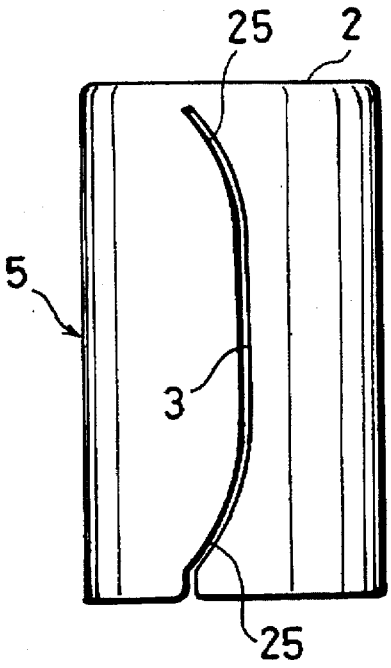
FIG. 13B is a schematic illustration showing a modification.
Figure 13C:
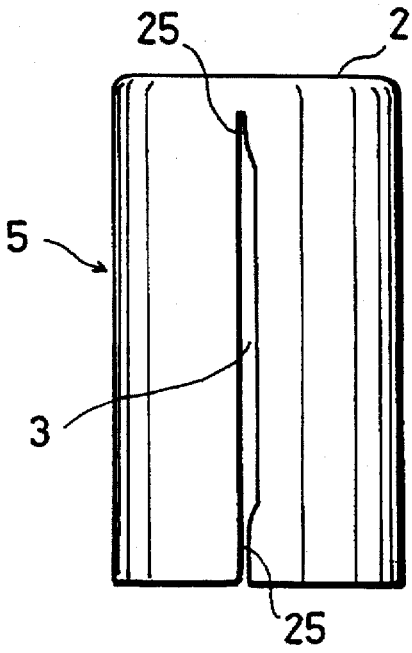
FIG. 13C is a schematic illustration showing a modification.
Figure 13D:
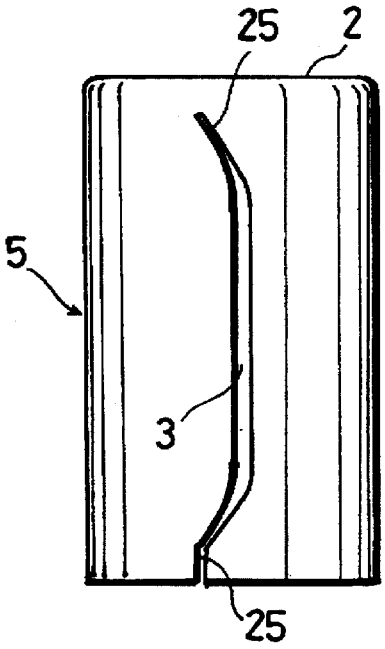
FIG. 13D is a schematic illustration showing a modification.

Next, FIGS. 13A to 13D show modifications of the case body 5. In FIG. 13A, approximately the whole portion of a slit window portion 3 is arc-shaped. In FIG. 13B, a central portion of a slit window portion 3 is straight and curves of both end portions 25 are arranged to be gentle and long as compared with the embodiment of FIG. 10. In FIG. 13C, widths of both end portions 25 of a slit window portion 3 are arranged to be smaller than a width of a central portion of the slit window portion 3, and both end portions 25 are not curved and the slit window portion 3, as a whole, is straight. In FIG. 13D, both end portions 25 of a slit window portion 3 are curved and widths of both end portions 25 are smaller than a width of a central portion of the slit window portion 3.

In FIGS. 13A–13D, illustration of a guide portion with protrusions and depressions 26 is omitted. However, it is preferable to arrange a guide portion with protrusions and depressions 26.

Figure 14:
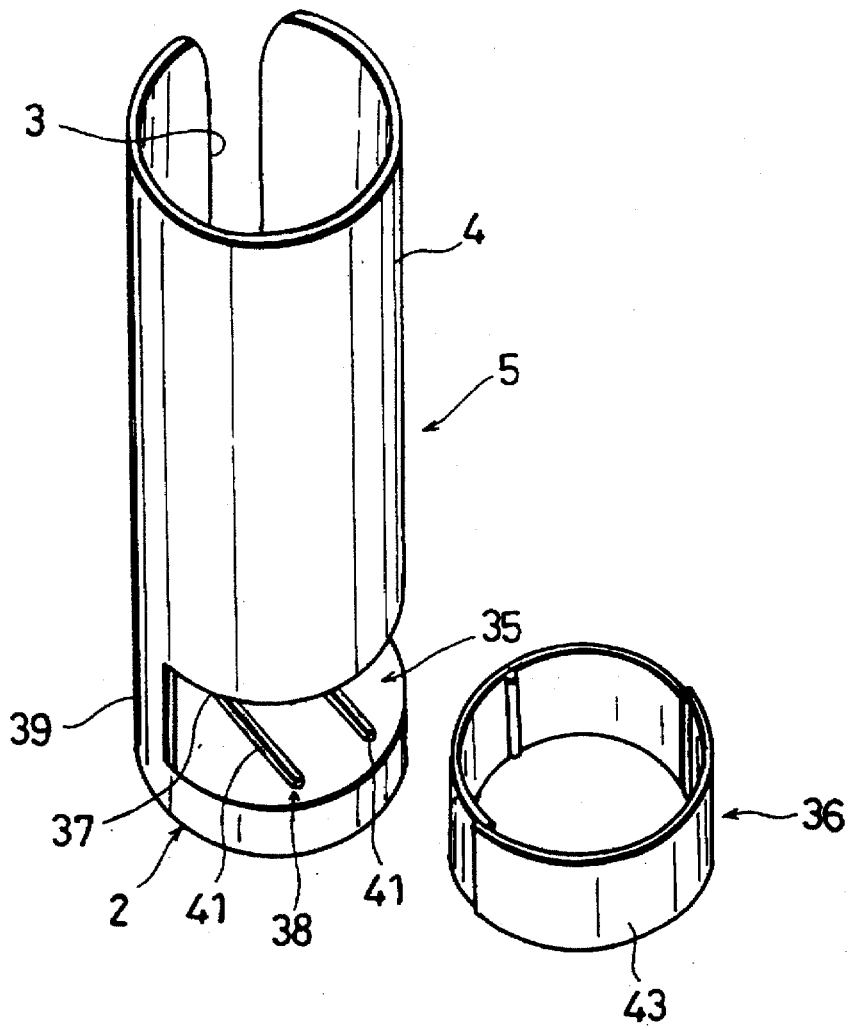
FIG. 14 is a perspective view showing a modification of a case body of the case.

Next, FIG. 14 shows a modification of the case body 5. A storeroom 35 which opens sideways is formed at a wall portion 2 of a case body 5, and a case, for storing small articles 36 and having a configuration of a bottomed cylinder, is contained in the storeroom 35.

In other words, a wall portion 2 is formed by an inner wall 37, an outer wall 38, and an arc-shaped circumferential wall portion 39 connecting the inner wall 37 and the outer wall 38, and a storeroom 35 is arranged between the inner wall 37 and the outer wall 38. A pair of parallel guiding linear protuberances 41 are arranged on an inner face of the outer wall 38. The circumferential wall portion 39 forms a part of the circumferential wall 4.

Figure 15:
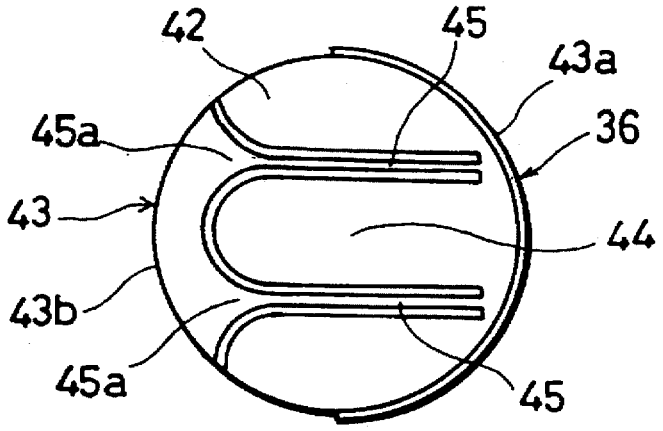
FIG. 15 is a bottom view of a case for storing small articles.

The case for storing small articles 36 is provided with a bottom wall 42 and a circumferential wall 43. As shown in FIG. 15, guide ways 45 are formed on a bottom face 44 of the circumferential wall 43, and guide the case for storing small articles 36 into the store room 35 which is guided by the guiding linear protuberances 41. These guide ways 45 consist of linear protrusions formed on the bottom face 44, and opening portions 45*a* gradually extend therefrom.

The circumferential wall 43 of the case for storing small articles 36 comprises a big diameter portion 43*a* and a small diameter portion 43*b*. When the small diameter portion 43*b* is contained in the storeroom 35, the small diameter portion 43*b* is along an inner face of the circumferential wall portion 39, and an outer face of the big diameter portion 43*a* becomes flush with an outer face of the circumferential wall 4 of the case body 5. When the case for storing small articles 36 contains the small article 36, a step portion formed on the circumferential wall 43 contacts a marginal end of the circumferential wall portion 39.

If a case for storing small articles 36 is arranged as described above, small articles of various kinds, for example, a ring, a necklace, earrings, and a tie pin, can be stored in the case for storing small articles 36.

According to the present invention composed as described in the foregoing, the following effects are obtained.

An ornament N can be stored compactly without forming wrinkles, and wrinkles can be smoothed away when storing the ornament N. Therefore, this makes it convenient to carry the ornament N, in a bag or other luggage, on a journey or a business trip.

Moreover, it is possible to display an ornament N stored in the case in a window of a shop with an end portion of the ornament N pulled out from the slit window portion 3 of the case body 5. In case of selling the ornament N, the ornament N can be swiftly and easily stored in the case, and this makes it easier to pack-up the ornament N.

Although the bar 13 has a bifurcated configuration, the bar 13 does not break easily and the bar 13 easily rotates on the axis L which makes it easier to store the ornament N. If the case body 5 is transparent, an ornament N completely stored in the case can be seen from outside of the case, and the ornament N can be displayed for sale under this situation.

If the case possesses a case for storing small articles 36, it is possible to store small articles of various kinds (for example, a ring and earrings).

While preferred embodiments of the present invention have been described in this specification, it is to be understood that the invention is illustrative and not restrictive, because various changes are possible within the spirit and indispensable features.

For example, it is possible to make the case body 5 transparent and the cap 6 opaque, or to make both the case body 5 and the cap 6 opaque. It is desirable to attached a member impregnated with a deodorizer, an aromatic, or a smoothing solution near an inner circumferential marginal end of the slit window portion 3.

It also is preferable to form the case body 5 or the cap 6 from antibacterial or deodorant plastic. It is possible to prevent bacteria-microbes if antibacterial plastic is used, and it is possible to prevent odor if deodorant plastic is used.

I claim:

1. A case for storing a band-shaped personal ornament said case comprising:

a case means body having a cylindrical configuration with an opening portion at a first end and a wall portion at a second end and having a circumferential wall possessing a slit window portion parallel to an axis of said case body and a cap which is detachable and freely rotates in a circumferential direction at said opening portion of said case body;

a bar, for winding said band-shaped personal ornament which approximately coincides with said axis of said case body, which is attached to an inner face of said cap;

a holding portion where an end portion of said bar for winding said band-shaped personal ornament is held and rotates freely rotates at a central portion of an inner face of said wall portion of said case body; and a guide portion having protrusions and depressions for spreading said band-shaped personal ornament toward a width direction of said band-shaped personal ornament, wherein said guide portion is formed near said slit window portion of said case body.

2. The case for storing said band-shaped personal ornament as set forth in claim 1, wherein said bar for winding said band-shaped personal ornament bifurcates into a long piece and a short piece between which a part of said band-shaped personal ornament is held, and an end portion of said long piece approximately coincides with said axis of said case body through a curved portion.

3. The case for storing said band-shaped personal ornament as set forth in claim 1, wherein said holding portion of said wall portion of said case body is arranged to be a depression where said end portion of said bar for winding said band-shaped personal ornament of said cap is fitted and freely rotates on said axis of said case body.

4. The case for storing said band-shaped personal ornament as set forth in claim 1, further comprising:

a depression which is formed at said end portion of said bar for winding said band-shaped personal ornament of said cap; and a small projection, which fits in said depression and freely rotates on said axis of said case body, is formed at said inner face of said wall protion of said case body and is arranged to be said holding portion of said wall portion.

5. The case for storing said band-shaped personal ornament as set forth in claim 1, wherein said case body is formed from transparent resin.

6. The case for storing said band-shaped personal ornament as set forth in claim 1, wherein first and second end portions of said slit window portion of said case body are arc-shaped when viewed from a front of said slit window portion of said case body.

7. The case for storing said band-shaped personal ornament as set forth in claim 1, wherein a slit, for hitching said band-shaped personal ornament between a long piece and a short piece of said bar for winding said band-shaped personal ornament, is arranged at a central portion in an axial direction of said bar.

8. The case for storing said band-shaped personal ornament as set forth in claim 1, wherein a slit, for hitching said band-shaped personal ornament between a long piece and a short piece of said bar for winding said band-shaped personal ornament, is arranged to begin at a point adjacent to a base end portion of said bar for winding said band-shaped personal ornament and end at a point adjacent to an end portion of said bar.

9. The case for storing said band-shaped personal ornament as set forth in claim 1, wherein said case body and said cap are formed from antibacterial or deodorant plastic.

10. The case for storing said band-shaped personal ornament as set forth in claim 1, wherein a storeroom which opens sideways is formed at said wall portion of said case body and a case for storing small articles is freely fitted in or removed from said storeroom.

* * * * *